United States Patent [19]

Dobson

[11] 4,210,288

[45] Jul. 1, 1980

[54] COOLING APPARATUS

[75] Inventor: John C. Dobson, Sheffield, England

[73] Assignee: Davy-Loewy Limited, Sheffield, England

[21] Appl. No.: 874,740

[22] Filed: Feb. 3, 1978

[30] Foreign Application Priority Data

Feb. 7, 1977 [GB] United Kingdom ..... 4932/77

[51] Int. Cl.[2] ..... B05B 1/00

[52] U.S. Cl. ..... 239/597; 266/113

[58] Field of Search ..... 239/193, 553.5, 553.3, 239/590.3, 590.5, 592, 597; 266/113, 114, 259

[56] References Cited

U.S. PATENT DOCUMENTS

| | | | |
|---|---|---|---|
| 2,624,559 | 1/1953 | Hyde | 239/590.3 X |
| 3,420,447 | 1/1969 | Howard | 239/553.3 X |
| 3,856,281 | 12/1974 | Bertolotti | 134/64 R |
| 4,076,222 | 2/1978 | Schaming | 266/113 X |

FOREIGN PATENT DOCUMENTS

| | | | |
|---|---|---|---|
| 47-490 | 8/1972 | Japan | 239/597 |
| 1290108 | 9/1972 | United Kingdom | 239/553.5 |

*Primary Examiner*—Robert B. Reeves
*Assistant Examiner*—Gene A. Church
*Attorney, Agent, or Firm*—Daniel Patch; Suzanne Kikel

[57] ABSTRACT

An apparatus for producing a continuous curtain of cooling liquid to cool a hot metal workpiece issuing from a rolling mill. A header tank with an elongated slot formed lengthwise along its underside is provided. An elongated nozzle, located in the header has an outlet extending from the slot. Both the inlet and outlet of the nozzle are generally rectangular in form but differ considerably in cross-section. An insert divides the nozzle into several passageways.

11 Claims, 5 Drawing Figures

COOLING APPARATUS

Figure 1:
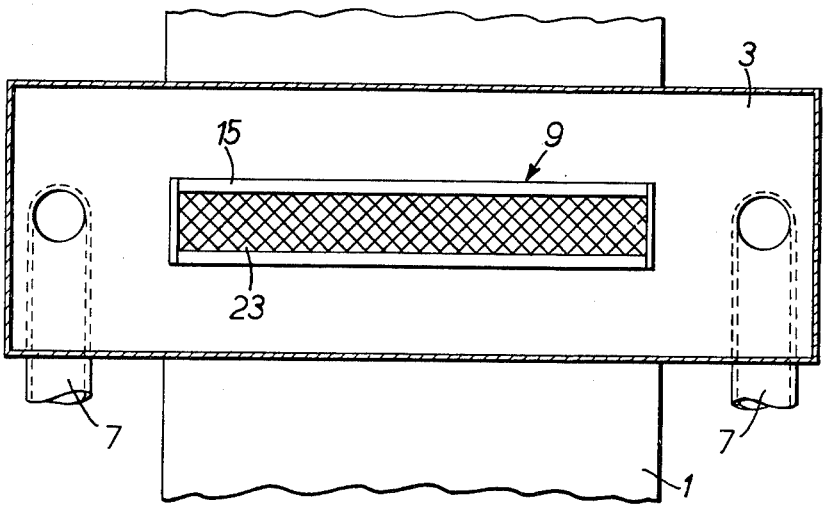

This invention relates to cooling apparatus for supplying a coherent curtain of cooling liquid, which is usually water. By the term "coherent" is meant continuous, that is, without breaks.

Such apparatus has been proposed for producing a curtain of cooling liquid for cooling metal workpieces in elongate form which are at high temperature, for example, metal strip issuing from a rolling mill. It is also known that, in order to achieve a desirable metallurgical structure in the workpiece being cooled, the cooling should be uniform across the width of the workpiece and preferably cooling should be uniform through the thickness of the strip.

In U.S. Pat. No. 3,856,281 in order to produce a liquid curtain, it has been suggested to employ a nozzle with a slot mouth, the length of which is many times the width, and with the internal walls of the nozzle converging smoothly to the mouth with the aim of reducing turbulence where the liquid leaves the mouth of the nozzle. This arrangement is only successful if the height of the curtain is kept less than five feet or so. If an attempt is made to increase the height of the curtain, it has been found that the curtain is no longer coherent and breaks appear in it. This of course is unsatisfactory when uniform cooling is required.

A liquid curtain of five feet or so in height cannot conveniently be used for cooling the upper surface of hot metal strip issuing from a rolling mill because the outlet of the nozzle is positioned only five feet above the hot metal strip and the nozzle is easily damaged by the strip if a "cobble" causes part of the strip to be lifted upwardly from the roller table on which it is supported. In practice, therefore, means for producing a water curtain of about five feet in height is not suitable for cooling the upper surface of hot metal strip issuing from a rolling mill.

It is an object of the present invention to provide means for producing a coherent curtain of cooling liquid which can be of greater height than that produced by the apparatus referred to above.

According to the present invention, apparatus for supplying a coherent curtain of cooling liquid comprises (a) a nozzle having an inlet and an outlet, each of elongate generally rectangular form but with the inlet having a considerably greater cross-sectional area than the outlet, and a portion located between the inlet and the outlet and containing means which divide the interior of that portion of the nozzle into a multiplicity of individual but contiguous passages extending in the direction between said inlet and said outlet, and (b) a header tank having provision for receiving liquid coolant and in which at least the inlet of the nozzle is located, and wherein the outlet of the nozzle is outside of the header tank or communicates with an elongate slot in a wall of the header tank.

Apparatus in accordance with the invention is capable of producing a coherent curtain of liquid coolant in excess of seven feet in height and this means that when the apparatus is used for cooling the upper surface of hot metal strip issuing from a rolling mill, the outlet of the nozzle is at least seven feet above the metal strip thereby reducing the risk of damage to the apparatus when a "cobble" occurs.

Furthermore, a coherent curtain is produced over a considerable range of liquid flow rates and this facilitates the efficient and controllable cooling of strip of various thicknesses.

The nozzle conveniently has a convergent portion extending between the inlet and the adjacent end of a parallel-sided portion containing the dividing means and furthermore the outlet of the nozzle may be defined by a further parallel-sided portion. In this case the nozzle may have a further convergent portion extending between the two parallel-sided portions.

The dividing means is conveniently an insert and this may be of shaped metal or of plastics material.

In use, the apparatus is mounted above the path of the workpiece to be cooled with the length of the nozzle extending transverse to the path. When liquid coolant is supplied to the header tank, it overflows into the inlet of the nozzle and a uniform curtain of coolant flows from the outlet of the nozzle on the the workpiece.

To cool the underside of the workpiece, similar apparatus is located beneath the path of movement of the workpiece with the outlet of the nozzle directed upwardly so that, in use, the liquid coolant flows from the outlet of the nozzle in the form of a curtain which engages the underside of the workpiece. The outlet of the nozzle is conveniently about 10 cm from the undersurface of the workpiece. Cooling curtains can be applied simultaneously to the top and under surfaces of a hot workpiece and equal rates of cooling to each surface can be achieved.

At the ends of the liquid curtain discharged from the nozzle, surface tension effects bring about a reduction in the length of the curtain, i.e. the dimension in the direction of the length of the mouth of the nozzle. Secondly, the surface tension effects tend to cause an increase in the thickness of the curtain at its ends. In other words, the cross-section of the curtain at some distance from the nozzle approximates to the shape of a dog's bone. Under many circumstances, the reduction in length of the curtain and of the thickening of the ends of the curtain are of no significance because the curtain is made slightly longer than the width of the workpiece and the ends of the curtain are outside the edges of the workpiece. If, however, the width of the workpiece is equal to or slightly longer than the length of the outlet of the nozzle, this results in the edges of the workpiece being deprived of cooling liquid and hence left uncooled. Furthermore, the increases in thickness at the edges of the curtain result in a greater cooling of those parts of the workpiece contacted by the edges of the curtain than that of central parts. Both of these effects may result in non-uniformity of cooling across the width of the workpiece.

This disadvantage, if it is a disadvantage, can be overcome by modifying the nozzle such that liquid coolant leaving the outlet of the nozzle is in the form of a curtain divergent in the direction of its length. To this end it is convenient for one or more passages at each of the opposite ends of the elongate nozzle to be inclined so that their ends, which are adjacent the outlet of the nozzle, are inclined outwardly with respect to the other passages.

Figure 2:
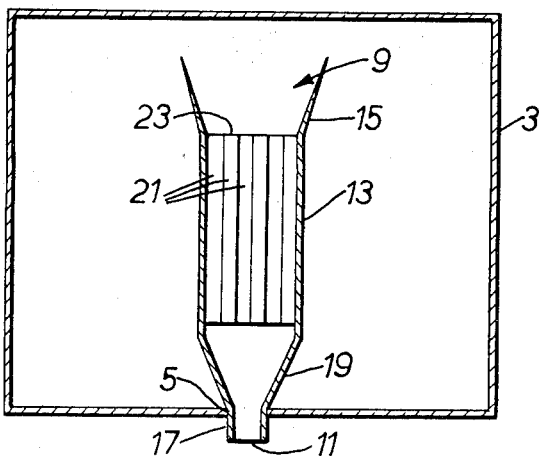
Figure 3:
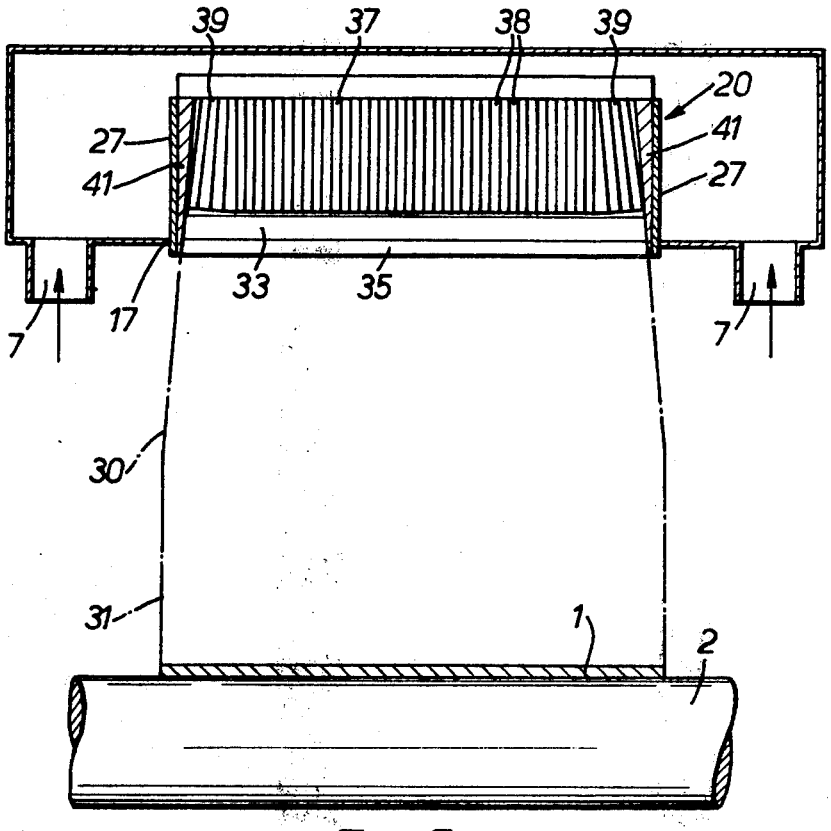
Figure 4:
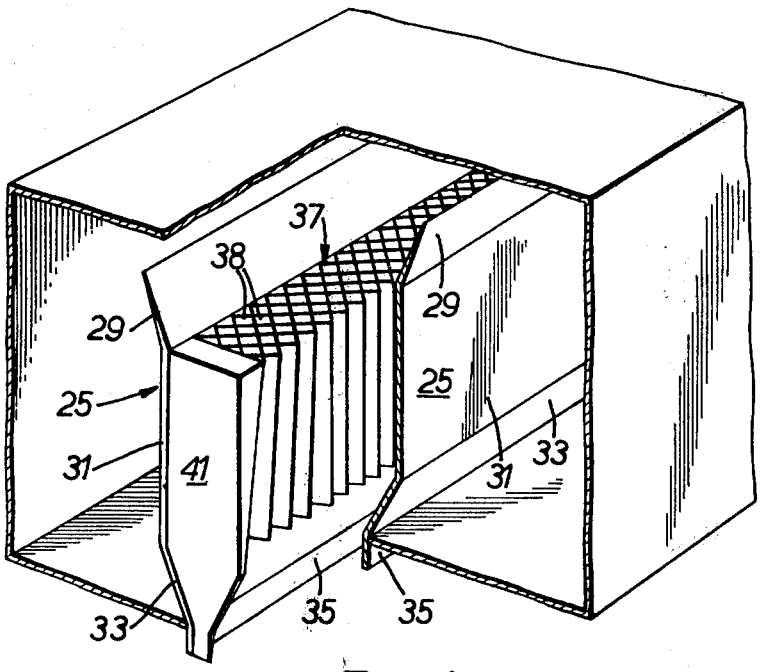
Figure 5:
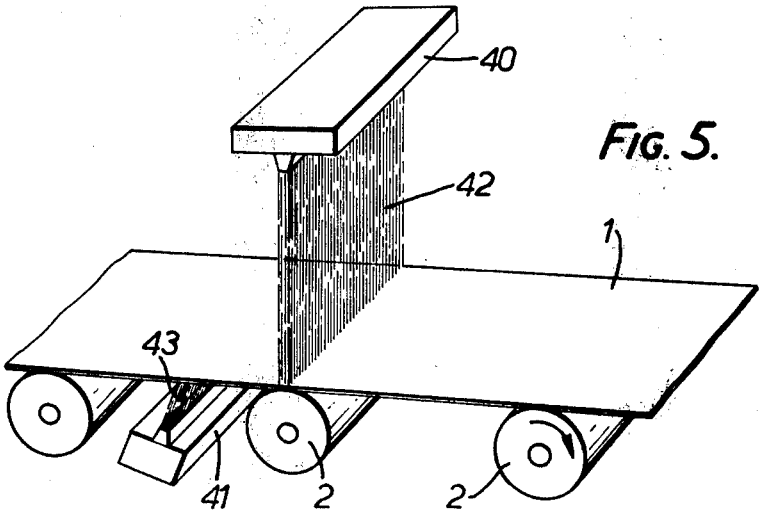

In order that the invention may be more readily understood it will now be described, by way of example only, with reference to the accompanying drawings, in which:

FIG. 1 is a plan view of apparatus in accordance with one embodiment of the invention, FIG. 2 is a sectional side elevation of the apparatus shown in FIG. 1, FIG. 3 is a sectional front elevation of apparatus according to a second embodiment of the invention, FIG. 4 is a perspective view, partly cut away, of part of the apparatus shown in FIG. 3, and FIG. 5 is a diagrammatic view of apparatus for producing coherent curtains of cooling liquid on opposite surfaces of metal strip.

During the manufacture of metal strip, it is necessary to cool the hot rolled material before it is coiled. To this end it is usual to cool the strip with liquid coolant, usually water, between the last stand of the rolling mill and the coiling apparatus. To ensure that there are uniform metallurgical properties throughout the strip, it is essential that each part thereof has the same degree of cooling.

Referring now to FIGS. 1 and 2, a metal strip 1 passing along a roller table (not shown), passes beneath a header tank 3 which has an elongate slot 5 in its underside. The slot is considerably longer than its width and it is arranged substantially normal to the direction of movement of the strip 1. Cooling water is directed into the header tank 3 through inlet pipes 7 which are in communication with the interior of the header tank.

Inside the tank there is a nozzle having an inlet 9 and an outlet 11 each of elongate generally rectangular form but the cross-sectional area of the inlet is considerably greater than that of the outlet. Between the inlet and the outlet there is a parallel-sided portion 13 which is connected at its upper end to the inlet 9 by a convergent portion 15 and the lower end of the portion 13 is connected to a further parallel-sided portion 17 by a further convergent portion 19. The interior of that part of the nozzle contained between the parallel-sides 13 is divided into a multiplicity of individual but contiguous passages 21 which extend in the direction between the inlet and the outlet. The passages are defined by an insert 23 of metal or plastics material. The insert provides a multiplicity of separate tubes which may be of rectangular or other convenient cross-section.

Referring now to FIGS. 3 and 4, in FIG. 3 an elongate moving workpiece to be cooled is illustrated as a metal strip or plate 1 on a roller table represented by roller 2.

Mounted above and extending across the roller table is a header tank having a central rectangular opening 17 in its bottom. A nozzle 20 is located within the header and extends downwardly and through the opening 17. The nozzle comprises a pair of side plates 25, the ends of which are secured to end plates 27. The side and end plates 25, 27 terminate at their upper ends below the top of the header and at their lower ends are in a water-tight fit in the opening 17. Because of the shaping of the side plates 25, the nozzle has a first convergent portion formed between inclined parts 29, a vertical, parallel-sided portion formed between vertical parts 31, a second convergent portion formed between inwardly inclined parts 33 and finally a short terminal portion extending through the opening 17 and formed by parallel vertical parts 35.

Located within the vertical portion of the nozzle, and between the vertical parts 31, is an insert 37 in the form of guides which divide the nozzle into a multiplicity of individual, but contiguous, passages 38 which, except at the ends of the nozzle, are parallel and vertical. At the nozzle ends, the guide passages are inclined at gradually increasing angles as illustrated at 39; because the walls of the passages at the extremities of the insert are inclined to the vertical, the space between them and the end walls 27 are filled with solid wedges 41 which extend to the outlet of the nozzle. The passages 38 have largely square cross-section and the guide insert may be made out of expanded metal or as a moulding or extrusion of suitable plastics material.

In operation, water is supplied at low pressure (say 4 psi) to the inlets 7 and flows at low velocity over the weirs formed by the sharp upper edges of the top inclined parts 29 of the nozzle side plates 25. The water flows smoothly down the inner walls of those parts of the insert and because of the weirs the flow of water to the insert is uniform over the nozzle length, i.e. that dimension parallel to the opening 17. The water then fills and flows through all the passages 38 which are so dimensioned that the flow through each is constrained to the vertical and any turbulence present in the entry water is removed. Finally the water leaves the passages, and the individual flows emerge into a single coherent flow which converges between the parts 33 and is discharged through the mouth formed by the parts 35 to fall as a coherent curtain on to the workpiece 1.

The non-vertical passages 39 give a horizontal component of velocity to the water at the ends of the nozzle so that the curtain, as it leaves the nozzle, is divergent as indicated by lines 30 representing the edges of the curtain. The surface tension effect, previously mentioned, operates to draw inwardly the edges of the curtain, with the result that the divergence is progressively reduced as the water falls, and in fact the divergence changes to a convergence, as indicated by the lines 31. The angles the passages 39 make to the vertical are chosen so that the width of the curtain at impingement on the workpiece is approximately equal to the width of the nozzle mouth, i.e. the distance between the end plates 27. Consequently, the workpiece is cooled uniformly across its width.

While the apparatus illustrated in FIGS. 1 to 4 of the drawings is located above the roller table, it is to be understood that similar apparatus, modified if necessary, is disposed below the table to apply coolant to the underside of the workpiece.

FIG. 5 illustrates a typical installation for cooling hot metal strip or plate 1 issuing from a rolling mill. The workpiece is supported on a roller table 2 and curtains of cooling liquid 42, 43 are directed to the upper and under sides respectively of the workpiece. The upper curtain is produced by a nozzle 40, such as that shown in FIGS. 3 and 4, and conveniently it is arranged to impinge on the workpiece immediately above one of the rollers of the roller table 2.

The nozzle 41 positioned beneath the strip may be inclined as shown in the figure so that the curtain 43 impinges on the underside of the strip at an angle inclined to the vertical. In this way, water does not fall back on to the curtain when there is no strip immediately above the curtain, as is the case at the beginning and end of rolling.

In accordance with the provisions of the patent statutes, I have explained the principle and operation of my invention and have illustrated and described what I consider to represent the best embodiment thereof.

What I claim as my invention and desire to secure by Letters Patent is:

1. Apparatus for supplying a coherent curtain of cooling liquid of a given length comprising:

(a) a nozzle having an inlet and an outlet, each of elongate generally rectangular form substantially equal to said given length, but with the inlet having a considerably greater cross-sectional area than the outlet, and a portion of said same form and substantially equal to said length located between the inlet and the outlet and containing means which divide the interior of that portion of the nozzle into a multiplicity of individual but continuous passages extending in the direction between said inlet and said outlet, (b) said portion also having a constraining portion located between said inlet and said means being at least equal in cross sectional area to the cross-sectional area of the adjacent portion of said means, (c) a header tank having provision for receiving liquid coolant and in which at least the inlet of the nozzle is located, and wherein the outlet of the nozzle is outside of the header tank or communicates with an elongate slot in a wall of the header tank, (d) said header tank arranged to extend substantially parallel to and be at least equal to said given length, and (e) said elongated slot arranged to extend substantially parallel to and substantially equal to said given length. outlet of the nozzle.

2. Apparatus as claimed in claim 1, in which the nozzle has a convergent portion extending between the inlet and the adjacent end of the portion which contains the dividing means.

3. Apparatus as claimed in claim 1, in which the outlet of the nozzle is defined by a parallel-sided or convergent portion of the nozzle.

4. Apparatus as claimed in claim 3, in which the nozzle has a further convergent portion extending between the portions containing the dividing means and the portion defining the outlet of the nozzle.

5. Apparatus as claimed in claim 1, in which the dividing means is at least one insert providing a plurality of separate tubes.

6. Apparatus as claimed in claim 1, in which the dividing means comprises a multiplicity of individual tubes.

7. Apparatus as claimed in claim 5, in which the dividing means is of plastics material.

8. Apparatus as claimed in claim 1, in which the nozzle is modified such that liquid coolant leaving the outlet of the nozzle is in the form of a curtain divergent in the direction of its length.

9. Apparatus as claimed in claim 8, wherein one or more of said contiguous passages at each of the opposite ends of the elongate nozzle are inclined so that their ends which are adjacent the outlet of the nozzle are inclined outwardly with respect to the other passages.

10. Apparatus as claimed in claim 9, in which a plurality of passages at each end of the insert are inclined relative to the remaining non-inclined passages through angles which progressively increase towards the end of the insert.

11. Apparatus as claimed in claim 10, wherein the end walls of the nozzle are inclined outwardly to maintain the divergency set up by the inclined passages of the insert.

* * * * *

UNITED STATES PATENT AND TRADEMARK OFFICE

CERTIFICATE OF CORRECTION

PATENT NO. : 4,210,288

DATED : July 1, 1980

INVENTOR(S) : John C. Dobson

It is certified that error appears in the above-identified patent and that said Letters Patent are hereby corrected as shown below:

Column 2, line 19 - after "on" the first "the" should be changed to --to--.

Column 5, Claim 1, line 9 in (a) paragraph. Before "passages" the word "continuous" should be --contiguous--.

Column 5, Claim 1 (e) paragraph, the last words "outlet of the nozzle" should be deleted.

Signed and Sealed this

*Eleventh* Day of *November 1980*

[SEAL]

*Attest:*

SIDNEY A. DIAMOND

*Attesting Officer*

*Commissioner of Patents and Trademarks*